US011193271B2

(12) United States Patent
Simonic

(10) Patent No.: US 11,193,271 B2
(45) Date of Patent: Dec. 7, 2021

(54) PROCESS FOR PRODUCING A RECESS IN THE BASE REGION OF A WALL CONSTRUCTION, CORRESPONDING WALL CONSTRUCTION AND SYSTEM AND CONSTRUCTION ELEMENT THEREFOR

(71) Applicant: KNAUF GIPS KG, Iphofen (DE)

(72) Inventor: Boris Simonic, Rijeka (HR)

(73) Assignee: KNAUF GIPS KG, Iphofen (DE)

( * ) Notice: Subject to any disclaimer, the term of this patent is extended or adjusted under 35 U.S.C. 154(b) by 0 days.

(21) Appl. No.: 16/612,291

(22) PCT Filed: May 16, 2018

(86) PCT No.: PCT/EP2018/000257

§ 371 (c)(1),
(2) Date: Nov. 8, 2019

(87) PCT Pub. No.: WO2018/219491

PCT Pub. Date: Dec. 6, 2018

(65) Prior Publication Data

US 2020/0199869 A1 Jun. 25, 2020

(30) Foreign Application Priority Data

May 31, 2017 (DE) ..... 102017005211.5

(51) Int. Cl.
*E04B 2/74* (2006.01)
*E04B 2/82* (2006.01)
(Continued)

(52) U.S. Cl.
CPC ..... *E04B 2/7411* (2013.01); *E04B 2/7457* (2013.01); *E04B 1/948* (2013.01);
(Continued)

(58) Field of Classification Search
CPC ..... E04B 2/7411; E04B 2/7457; E04B 1/948; E04B 2/7412; E04B 2/821; E04C 2003/0473
(Continued)

(56) References Cited

U.S. PATENT DOCUMENTS 2,766,855 A 10/1956 Johnson et al.
3,120,031 A * 2/1964 Bohnsack ..... E04B 2/78 52/241
(Continued)

FOREIGN PATENT DOCUMENTS

DE 2418253 A1 11/1975
DE 2724169 A1 11/1978
EP 1239093 A2 * 9/2002 ..... B32B 7/12

OTHER PUBLICATIONS

DE2724169A1 Machine Translation (Year: 2020).*
(Continued)

*Primary Examiner* — Brent W Herring
(74) *Attorney, Agent, or Firm* — Greer, Burns & Crain, Ltd.

(57) ABSTRACT

A process for producing a recess ("negative base") in the base region of a wall construction in the drywall technique, preferably a wall construction with fire protection and/or sound insulation, wherein for the wall construction on a stud frame, using board-shaped construction elements, preferably construction elements containing gypsum and/or cement, a paneling is attached on both sides of the stud frame, and wherein at least one side of the stud frame is provided with a double-layer paneling, the outer paneling layer of which is recessed in order to produce the recess in the base region, a compensating insulant is introduced into the intermediate space between the panelings of the stud frame at least over the vertical height of the recess in the base region in order
(Continued)

to compensate the weakening of the base region resulting from the recessed paneling.

16 Claims, 1 Drawing Sheet

(51) Int. Cl.
*E04B 1/94* (2006.01)
*E04C 3/04* (2006.01)

(52) U.S. Cl.
CPC ..... *E04B 2/7412* (2013.01); *E04B 2/821* (2013.01); *E04C 2003/0473* (2013.01)

(58) Field of Classification Search
USPC ..... 52/272, 293.1, 293.3, 506.06, 717.03, 52/317, 396.01
See application file for complete search history.

(56) References Cited

U.S. PATENT DOCUMENTS 3,140,564 A * 7/1964 Chapman ..... E06B 7/18 52/144
4,145,856 A * 3/1979 Wise ..... E04B 1/6137 52/127.11
4,557,973 A * 12/1985 Ali ..... C04B 20/1018 156/39
4,745,721 A * 5/1988 Gartner ..... E06B 1/6076 52/126.5
5,244,709 A * 9/1993 Vanderstukken ..... A62C 2/06 428/99
5,755,066 A * 5/1998 Becker ..... E04B 2/7411 52/241
7,152,385 B2 * 12/2006 Morgan ..... E04B 2/7411 52/745.05
7,398,856 B2 * 7/2008 Foster ..... E04B 2/7457 181/284
9,157,232 B2 * 10/2015 Stahl, Jr. ..... E04B 2/7411
10,000,923 B2 * 6/2018 Pilz ..... E04B 2/7457
10,323,411 B2 * 6/2019 Ackerman ..... E04B 1/947
2004/0045234 A1 * 3/2004 Morgan ..... E04B 2/7411 52/232
2008/0178782 A1 * 7/2008 Frobosilo ..... E04B 2/7457 109/78
2010/0180527 A1 * 7/2010 Kim ..... E04C 1/40 52/309.13
2010/0287878 A1 * 11/2010 Lee ..... E04C 3/293 52/834
2011/0024433 A1 * 2/2011 Rolland ..... B32B 27/34 220/592.2
2016/0208484 A1 * 7/2016 Pilz ..... E04B 2/7457
2018/0148923 A1 5/2018 Bravo Valenzuela
2019/0127974 A1 * 5/2019 Dicaire ..... E04B 1/948

OTHER PUBLICATIONS

Truini, "Rock-Wool Insulation: What It Is and Where to Use It", <https://www.hometips.com/buying-guides/rock-wool-insulation-use.html> (Year: 2020).*
International Search Report and Written Opinion from International Patent Application No. PCT/EP2018/000257, dated Oct. 4, 2018.
Petrone, C., et al., "Mechanical properties of plasterboards: experimental tests and statistical analysis," Journal of Materials in Civil Engineering, vol. 28, Issue 11, Nov. 2016, 26 pages.
Djurović-Petrović, M., "Experimental Investigation of Rockwool Insulation Hygrothermal Properties Related to Material Structure," Thermal Science, vol. 19, No. 3, 2015, pp. 923-928.

* cited by examiner

PROCESS FOR PRODUCING A RECESS IN THE BASE REGION OF A WALL CONSTRUCTION, CORRESPONDING WALL CONSTRUCTION AND SYSTEM AND CONSTRUCTION ELEMENT THEREFOR

BACKGROUND

The invention pertains to a process for producing a recess ("negative base") in the base region of a wall construction in the drywall technique, preferably a wall construction with fire protection and/or sound insulation, wherein for the wall construction on a stud frame, using board-shaped construction elements, preferably construction elements containing gypsum and/or cement, a paneling is attached on both sides, and wherein at least one side of the stud frame is provided with a double-layer paneling, the outer paneling layer of which is recessed in order to produce the recess in the base region.

The invention also pertains to a wall construction in the drywall technique, preferably a wall construction with fire protection and/or sound insulation, comprising a stud frame with board-shaped construction elements, preferably construction elements containing gypsum and/or cement attached on both sides of the stud frame, wherein for the production of a recess ("negative base") in the base region of the wall construction at least one side of the stud frame is provided with a double-layer paneling, the outer paneling layer of which is recessed, preferably in accordance with the above-described process, in order to produce the recess in the base region.

The invention furthermore pertains to a system for producing a wall construction, preferably a wall construction of the above-described type, and a construction element for such a wall construction.

A baseboard, which with respect to the interior design is coordinated, for example, with a floor covering, could be readily arranged on a wall construction of the above-described type.

With respect to the interior design, however, it is sometimes desirable to flush countersink a baseboard into the wall construction, thus to avoid an outwards projecting baseboard. In such instances, the space for accommodating the baseboard has to be produced in the base region of the wall construction itself in the form of a recess, into which the desired baseboard can be fitted, i.e. material has to be correspondingly removed or recessed from the wall construction in the base region, a so-called "negative baseboard." However, this weakens the wall construction in this region. Although such a wall construction preferably concerns a non-load bearing interior wall construction, such recessing of material is in fact not statically relevant, but can substantially weaken, in particular, fire protection and/or sound insulation walls and practically render their function completely ineffective.

In such instances, base regions of an outer layer of the paneling are usually recessed and the recessed paneling parts or suitably sized board parts are integrated into the wall construction by being screwed to the remaining continuous paneling from the inside rather than to a first paneling layer from the outside. However, this type of installation is extremely elaborate and also cannot always be practically realized.

The invention is therefore based on the objective of disclosing a simple alternative for compensating the weakening of a wall construction with a negative baseboard.

SUMMARY

According to the invention, this objective is attained in that a compensating insulant is introduced into the intermediate space between the panelings of the stud frame at least over the vertical height of the recess in the base region in order to compensate the weakening of the base region resulting from the recessed paneling.

The invention advantageously identifies that the weakening of the desired and required fire protection and/or sound insulation of the wall construction, which results from the reduction of the paneling, can be compensated in a surprisingly simple way by introducing a suitable, special compensating insulant.

In comparison with the integration and installation of replacement boards in the region of the stud frame of a wall construction, the compensating insulant initially provides the advantage that it can be introduced into the inner region of the wall construction in a very simple and accurately fitting way, as well as in a sufficient quantity and to a sufficient degree. In addition, other fire protection or sound-insulating measures or elements can thereby remain completely unaffected. For example, elastic decouplings between construction elements of the stud frame remain untouched and undamaged. Seals, preferably intumescent seals, can also remain untouched and unaffected. If applicable, the function of sliding profile connections can also remain unaffected. This preferably applies to wall constructions with single studs, as well as to wall constructions with double studs, for which the invention is likewise suitable. At this point, it should be noted that a base region does not necessarily have to refer to a floor base region, but inventive solutions can also be applied, for example, to ceiling baseboards if such ceiling baseboards are required with respect to the interior design or to required channels, for example, for lines integrated into wall bases.

According to the invention, rock wool can be used as a very suitable compensating insulant, if applicable in suitably compacted form.

According to an enhancement of the inventive process, it is proposed that the compensating insulant is advantageously already introduced into the base region of the stud frame during the construction of the stud frame or after the construction of the stud frame, but before the installation of the paneling that covers the region of the stud frame, such that this base region preferably is completely filled with the compensating insulant. This can preferably realized without mechanical fastening of the compensating insulant. The required inventive measures therefore can already be carried out at a suitable point in time during the erection of the wall construction such that the need for subsequent elaborate modifications of the base region is eliminated.

In a particularly simple and advantageous embodiment, the compensating insulant can preferably be placed into the base region in the form of strips.

Independent protection is also claimed for a wall construction in the drywall technique, preferably a wall construction with fire protection and/or sound insulation, which comprises a stud frame with board-shaped construction elements, preferably construction elements containing gypsum and/or cement, attached on both sides of the stud frame, wherein for the production of a recess ("negative base") in the base region of the wall construction at least one side of the stud frame is provided with a double-layer paneling, the outer paneling layer of which is recessed in order to produce the recess in the base region, preferably a wall construction produced in accordance with the above-described process, which as an independent solution to the above-defined objective is characterized in that a compensating insulant is introduced into the intermediate space between the panelings of the stud frame at least over the vertical height of the recess in the base region in order to compensate the weakening of the base region resulting from the recessed paneling.

As already mentioned above with reference to the inventive process, the compensating insulant introduced into the intermediate space between the panelings of the stud frame preferably comprises an insulant suitable for ensuring the fire protection and/or sound insulation, wherein rock wool proved preferably suitable for this purpose.

The intermediate space between the panelings of the stud frame preferably is completely filled with the compensating insulant at least in its base region.

As already mentioned above, the compensating insulant can preferably be arranged in the intermediate space between the panelings of the stud frame without mechanical fastening which significantly eases and simplifies its introduction. The compensating insulant can be introduced in a very simple way if preferably strips of the compensating insulant are placed into the base region.

Independent protection is likewise claimed for a system for producing a wall construction, preferably a wall construction with fire protection and/or sound insulation, which comprises profile elements for a stud frame and board-shaped construction elements, preferably construction elements containing gypsum and/or cement, for attaching an at least single-layer paneling to both sides of the stud frame, wherein at least one recess ("negative base") is produced in the base region of the wall construction, preferably for an inventive wall construction and/or a wall construction produced in accordance with the inventive process, which as an independent solution to the above-defined objective is characterized, according to the invention, by at least one compensating insulant strip for compensating the weakening of the base region resulting from the recessed paneling.

Independent protection is also claimed for a construction element for a wall construction, preferably a wall construction in the drywall technique with fire protection and/or sound insulation, which is characterized in that it comprises a strip of a highly heat-insulating, non-combustible and/or sound-absorbing insulant, preferably of rock wool, which is intended for being introduced into the base region of a stud frame. Characteristics of the different categories of claims can analogously also be considered as an enhancement of other categories and individually combined with one another.

BRIEF DESCRIPTION OF THE DRAWINGS

The attached drawings show exemplary embodiments, from which other inventive characteristics can also be gathered, but which basically should only be interpreted as examples and are not intended to restrict the object of the invention or its scope of protection in any way. In these drawings.

DETAILED DESCRIPTION

Figure 1:
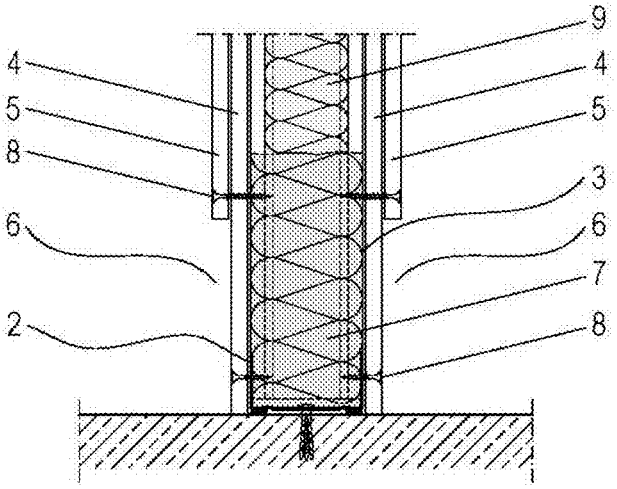
FIG. 1 shows a basic vertical section through an inventive base region of an exemplary wall construction with a stud frame comprising single studs.

FIG. 1 shows a basic vertical section through an inventive base region of an exemplary wall construction with a stud frame that comprises single studs.

The wall construction illustrated in FIG. 1 comprises in its shown base region a bottom rail 2 that is fixed on a floor 1, as well as stud profiles 3 that vertically rise from the bottom rail 2. Both sides of the stud profiles 3 are paneled with wall boards 4, 5 down to the floor 1. In the base region, however, the outer wall boards 5 are recessed or shortened on both sides of the stud profiles 3 in order to thereby respectively create a recess 6 in the base region. Not-shown baseboards can be fitted into these recesses 6 in such a way that they end flush with the outer surface of the outer wall boards 5, i.e. such that they do not or only slightly protrude into the room bordered or separated by the wall construction. This may have merely aesthetic reasons with respect to the interior design.

However, the remaining base region of the wall construction is narrowed and weakened in its illustrated cross section due to these recesses 6. This preferably counteracts any potential fire protection and/or sound insulation measures to be ensured with the wall construction.

According to the invention, this weakened fire protection and/or sound insulation is compensated in that a suitable, special compensating insulant 7, particularly a highly heat-insulating, non-combustible and/or sound-absorbing insulant, preferably rock wool, is introduced into the weakened base region, namely into the region of the compartments formed by the stud profiles 3 between the wall boards 4 of the inner paneling. This is preferably already carried out during or shortly after the construction of the stud frame, but before the panelings are attached or closed. With respect to the illustration in FIG. 1, it is noted that the fastening screws 8 shown merely serve for fastening the panelings on the stud frame whereas the compensating insulant 7 is preferably not mechanically fastened on the stud frame. The height of the special compensating insulant 7 preferably exceeds the height of the recesses 6 in the vertical direction.

The wall boards 4, 5 may preferably be gypsum boards, gypsum plaster boards or gypsum fiber boards.

A conventional insulant 9, for example glass wool, can be used above the special compensating insulant 7, i.e. in the regions, in which the double paneling is still intact.

Figure 2:
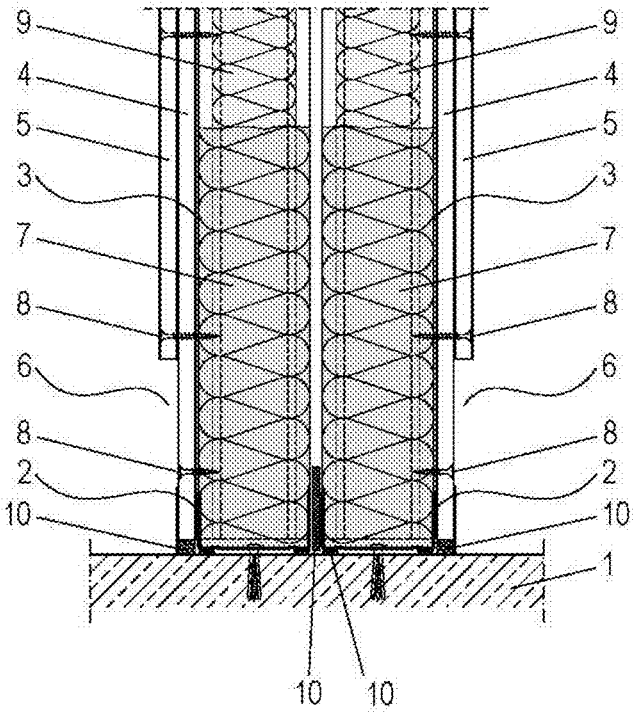
FIG. 2 shows a basic vertical section through an inventive base region of an exemplary wall construction with a stud frame comprising double studs.

FIG. 2 shows a basic vertical section through an inventive base region of an exemplary wall construction with a stud frame that comprises double studs. Identical construction elements are identified by the same reference symbols as in FIG. 1.

In contrast to the exemplary embodiment illustrated in FIG. 1, the wall construction in FIG. 2 has a double stud construction, i.e. two stud profiles 3 are arranged adjacent to one another. The panelings are arranged to both sides of this double stud construction and otherwise realized as in FIG. 1.

In addition, the wall construction in FIG. 2 features elastic damping elements 10 for acoustically damping and decoupling the wall construction.

The invention claimed is:

1. A process for producing a recess in the base region of a wall construction in the drywall technique, wherein the wall construction is a stud frame including a bottom rail, said bottom rail directly fastened to a floor, and stud profiles rising from the bottom rail using board-shaped construction elements, a paneling is attached on both sides of the stud frame, and wherein at least one side of the stud frame is provided with a double-layer paneling, including outer and inner panels secured to the stud frame, the process comprising: the outer paneling layer of the double-layer paneling is recessed in order to produce the recess in the base region; and a compensating insulant is introduced into an intermediate space between the inner panels of the stud frame and above the bottom rail to a level at least over the vertical height of the recess in the base region in order to compensate the weakening of the base region resulting from the recessed paneling, wherein the compensating insulant is compactable rock wool.

2. The process according to claim 1, characterized in that the compensating insulant used comprises an insulant suitable for ensuring the fire protection and/or sound insulation.

3. The process according to claim 1, characterized in that the compensating insulant is already introduced into the base region of the stud frame during the construction of the stud frame or after the construction of the stud frame, but before the installation of the paneling that covers the region of the stud frame.

4. The process according to claim 1, characterized in that the compensating insulant is introduced without mechanical fastening.

5. The process according to claim 1, characterized in that the compensating insulant is placed into the base region in the form of strips.

6. The process according to claim 1, wherein the wall construction has fire protection and/or sound insulation.

7. The process according to claim 1, wherein the board-shaped construction elements contain gypsum and/or cement.

8. A wall construction in the drywall technique, comprising: a bottom rail fixed to a floor, a stud frame including stud profiles rising from the bottom rail and provided with board-shaped construction elements, attached on both sides of the stud frame in a double-layer arrangement including an inner said panel and an outer said panel attached to opposing sides of the stud frame;

wherein for the production of a recess in a base region of the wall construction on at least one side of the stud frame the outer panel layer is recessed in order to produce the recess in the base region; and a compensating insulant introduced into an intermediate space above the bottom rail and between the inner panels of the stud frame in a region approximating the vertical height of the recess in the base region in order to compensate the weakening of the base region resulting from the recessed paneling, wherein the compensating insulant comprises compactable rock wool.

9. The wall construction according to claim 8, characterized in that the compensating insulant introduced into the intermediate space between the panelings of the stud frame comprises an insulant suitable for ensuring the fireproofing and/or sound insulation.

10. The wall construction according to claim 8, characterized in that the intermediate space between the panelings of the stud frame is completely filled with the compensating insulant at least in its base region.

11. The wall construction according to claim 8, characterized in that strips of compensating insulant are placed into the base region.

12. The wall construction according to claim 8, characterized in that the compensating insulant is arranged in the intermediate space between the panelings of the stud frame without mechanical fastening.

13. The wall construction according to claim 8, wherein the wall construction has fire protection and/or sound insulation.

14. The wall construction according to claim 8, wherein the board-shaped construction elements contain gypsum and/or cement.

15. A system for producing a wall construction, comprising:

profile elements for a stud frame and board-shaped construction elements, for attaching an at least single-layer paneling to both sides of the stud frame; wherein at least one recess is produced in the base region of the wall construction according to claim 8, further including at least one compensating insulant strip for compensating the weakening of the base region resulting from the recessed paneling.

16. A wall construction in the drywall technique, comprising:

a stud frame comprising dual stud profiles, each of the stud profiles comprising a bottom rail fixed directly to a floor, with sides extending from the bottom rail, with board-shaped construction elements, attached on both sides of each stud profile; wherein for the production of a recess in the base region of the wall construction at least one side of each stud profile is provided with a double-layer paneling, the outer paneling layer of which is recessed in order to produce the recess in the base region; and a compensating insulant introduced into the intermediate space above the bottom rail and between the panelings of each stud profile in a region approximating the vertical height of the recess in the base region in order to compensate the weakening of the base region resulting from the recessed paneling, wherein the compensating insulant comprises compactable rock wool and elastic dampening elements are located adjacent the bottom rail and/or below a lower edge of an inner panel of said double-layer paneling.

* * * * *